US007497192B2

(12) United States Patent
Yamada et al.

(10) Patent No.: US 7,497,192 B2
(45) Date of Patent: Mar. 3, 2009

(54) VARIABLE VALVE SYSTEM WITH CONTROL SHAFT ACTUATING MECHANISM

(75) Inventors: Yoshihiko Yamada, Kanagawa (JP); Mikihiro Kajiura, Tokyo (JP); Shigeru Kawakami, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 364 days.

(21) Appl. No.: 11/079,187

(22) Filed: Mar. 15, 2005

(65) Prior Publication Data

US 2005/0211205 A1 Sep. 29, 2005

(30) Foreign Application Priority Data

Mar. 24, 2004 (JP) ..... 2004-085904

(51) Int. Cl.
*F01L 1/34* (2006.01)

(52) U.S. Cl. ..... 123/90.16; 123/90.17

(58) Field of Classification Search ..... 123/90.15, 123/90.16, 90.17, 90.18, 90.2, 90.27, 90.31, 123/90.39, 90.44, 345, 346, 347, 348; 73/488
See application file for complete search history.

(56) References Cited

U.S. PATENT DOCUMENTS 4,570,118 A * 2/1986 Tomczak et al. ..... 324/207.2
5,361,630 A * 11/1994 Kowalski ..... 73/117.3
6,883,494 B2 * 4/2005 Kurita et al. ..... 123/337
7,047,921 B2 * 5/2006 Nakamura et al. ..... 123/90.16
7,171,931 B2 * 2/2007 Todo et al. ..... 123/90.16

FOREIGN PATENT DOCUMENTS

| | | |
|---|---|---|
| JP | 11-211410 | 8/1999 |
| JP | 2000-220413 | 8/2000 |
| JP | 2002-155716 A | 5/2002 |
| JP | 2002-235577 | 8/2002 |
| JP | 2004-076618 | 3/2004 |

* cited by examiner

*Primary Examiner*—Ching Chang
(74) *Attorney, Agent, or Firm*—Foley & Lardner LLP

(57) ABSTRACT

A variable valve system varies an operation condition of an engine valve by controlling an angular position of a control shaft in accordance with an operation condition of the engine. The system has an actuating mechanism for actuating the control shaft. The actuating mechanism comprises a mounting member that is connected to one end of the control shaft by means of bolts and has a projection projected axially in an opposite direction of the control shaft; a permanent magnet piece that is mounted on the projection thereby to rotate together with the control shaft; and a sensing device that senses a rotation condition of the permanent magnet piece.

9 Claims, 12 Drawing Sheets

VARIABLE VALVE SYSTEM WITH CONTROL SHAFT ACTUATING MECHANISM

BACKGROUND OF THE INVENTION

1. Field of the Invention

The present invention relates in general to variable valve systems of an internal combustion engine, which vary a lift degree or work angle of engine valves (viz., intake and exhaust valves) in accordance with an operation condition of the engine, and more particularly to the variable valve systems of a type that has an actuating mechanism for actuating a control shaft that constitutes part of a valve lift degree varying mechanism.

2. Description of the Related Art

Japanese Laid-open Patent Application (Tokkai) 2002-155716 shows a variable valve system of an internal combustion engine, which generally comprises a drive shaft that is driven by a crankshaft of the engine, a hollow camshaft that is concentrically disposed about the drive shaft to pivot about the same, a valve lift mechanism that induces an open/close operation of intake valves, a valve lift degree varying mechanism that is incorporated with the valve lift mechanism to vary a lift degree of the intake valves, and an actuating mechanism that actuates the valve lift degree varying mechanism in accordance with an operation condition of the engine. The actuating mechanism comprises an electric motor that is operated in accordance with the operation condition of the engine, and a ball-screw type transmission mechanism that transmits the torque of the electric motor to a control shaft that is a part of the valve lift degree varying mechanism.

The ball-screw type transmission mechanism comprises a housing, a ball-screw shaft that is rotatably held in the housing through bearings and driven by the electric motor, a ball-nut that is meshed with the ball-screw shaft and moved axially along the ball-screw shaft upon rotation of the shaft, and a link mechanism that transmits the motion of the ball-nut to the control shaft while converting the straight line motion to a rotary motion.

The link mechanism comprises a link member that has one end pivotally connected to the ball-nut, and an arm member that has one end pivotally connected to the other end of the link member and the other end connected through a bolt to an end of the control shaft.

Within the housing of the ball-screw type transmission mechanism, there is arranged a potentiometer that detects an angular position of the control shaft. The potentiometer comprises a center pin that is fixed to the arm member, a center arm that is engaged with the center pin to be turned by the same, and a sensor portion that derives the angular position of the control shaft based on an angular position that the arm member assumes.

Under operation of the engine, an information signal from the potentiometer is fed to a control unit together with other information signals from various sensor means, and thus, in accordance with the engine operation condition, the electric motor is operated to run by a controlled degree or time in positive or negative direction. Due to running of the motor, the ball-screw shaft is turned about its axis causing the ball-nut to move axially therealong. The movement of the ball-nut is transmitted to the control shaft through the link member and the arm member thereby to vary or control the rotation direction and rotation degree of the control shaft. With this, the lift degree (or work angle) of the intake valves is continuously varied in accordance with the engine operation condition, so that the engine can exhibit a satisfied engine performance in all operation mode from a low speed condition to a high speed condition.

SUMMARY OF THE INVENTION

According to the present invention, there is provided a variable valve system with a control shaft actuating mechanism, in which the control shaft actuating mechanism exhibits a quite high performance with respect to durability, reliability and cost as compared with the actuating mechanism of the variable valve system disclosed in the above-mentioned Laid-open Patent Application.

In accordance with a first aspect of the present invention, there is provided a variable valve system of an internal combustion engine for varying an operation condition of an engine valve by controlling an angular position of a control shaft in accordance with an operation condition of the engine, the system comprising an actuating mechanism for actuating the control shaft, the actuating mechanism comprising a mounting member connected to one end of the control shaft by means of bolts, the mounting member having a projection projected axially in an opposite direction of the control shaft; a permanent magnet piece mounted on the projection thereby to rotate together with the control shaft; and a sensing device for sensing a rotation condition of the permanent magnet piece.

In accordance with a second aspect of the present invention, there is provided a variable valve system for varying an operation condition of an engine valve that is biased in a valve closing direction by a valve spring, the system comprising a valve lift degree varying mechanism that varies the operation condition of the engine valve in accordance with an angular position assumed by a control shaft; an actuating mechanism that controls the angular position of the control shaft in accordance with an operation condition of the engine; a mounting member connected to one end of the control shaft to rotate therewith; a non-magnetic member integrally connected to the mounting member; a permanent magnet piece fixed to the non-magnetic member; and a sensing device that senses a rotation condition of the permanent magnet piece.

In accordance with a third aspect of the present invention, there is provided a variable valve system for varying an operation condition of an engine valve that is biased in a valve closing direction by a valve spring, the system comprising a valve lift degree varying mechanism that varies the operation condition of the engine valve in accordance with an angular position assumed by a control shaft; an actuating mechanism that controls the angular position of the control shaft in accordance with an operation condition of the engine; a mounting member connected to one end of the control shaft to rotate therewith; a non-magnetic member connected to the mounting member; a permanent magnet piece fixed to the non-magnetic member; a sensing device that senses a rotation condition of the permanent magnet piece; and a guard cap that covers the permanent magnet piece except a portion that faces the sensing device, the guard cap being constructed of a non-magnetic material.

Other objects of the present invention will become apparent from the following description when taken in conjunction with the accompanying drawings.

BRIEF DESCRIPTION OF THE DRAWINGS

FIGS. 9A and 9B are views taken from the direction of the arrow "C" of FIG. 8, in which FIG. 9A shows a valve closing condition under the lowest lift of the intake valves, and FIG. 9B shows a valve opening condition under the lowest lift of the intake valves;

FIGS. 10A and 10B are views similar to FIGS. 9A and 9B, but in which FIG. 10A shows a valve closing condition under the highest lift of the intake valves, and FIG. 10B shows a valve opening condition under the highest lift of the intake valves;

DETAILED DESCRIPTION OF THE EMBODIMENTS

In the following, two embodiments 100 and 200 of the present invention will be described in detail with reference to the accompanying drawings.

For ease of understanding, various directional terms, such as, right, left, upper, lower, rightward and the like are used in the following description. However, such terms are to be understood with respect to only a drawing or drawings on which corresponding part or portion is shown. Throughout the description, substantially same parts or portions are denoted by the same numerals and repetitive explanation on them will be omitted for simplification of the description.

Referring to FIGS. 1 to 8, 9A, 9B, 10A and 10B of the drawings, there is shown a variable valve system 100 of a first embodiment of the present invention.

Figure 5:
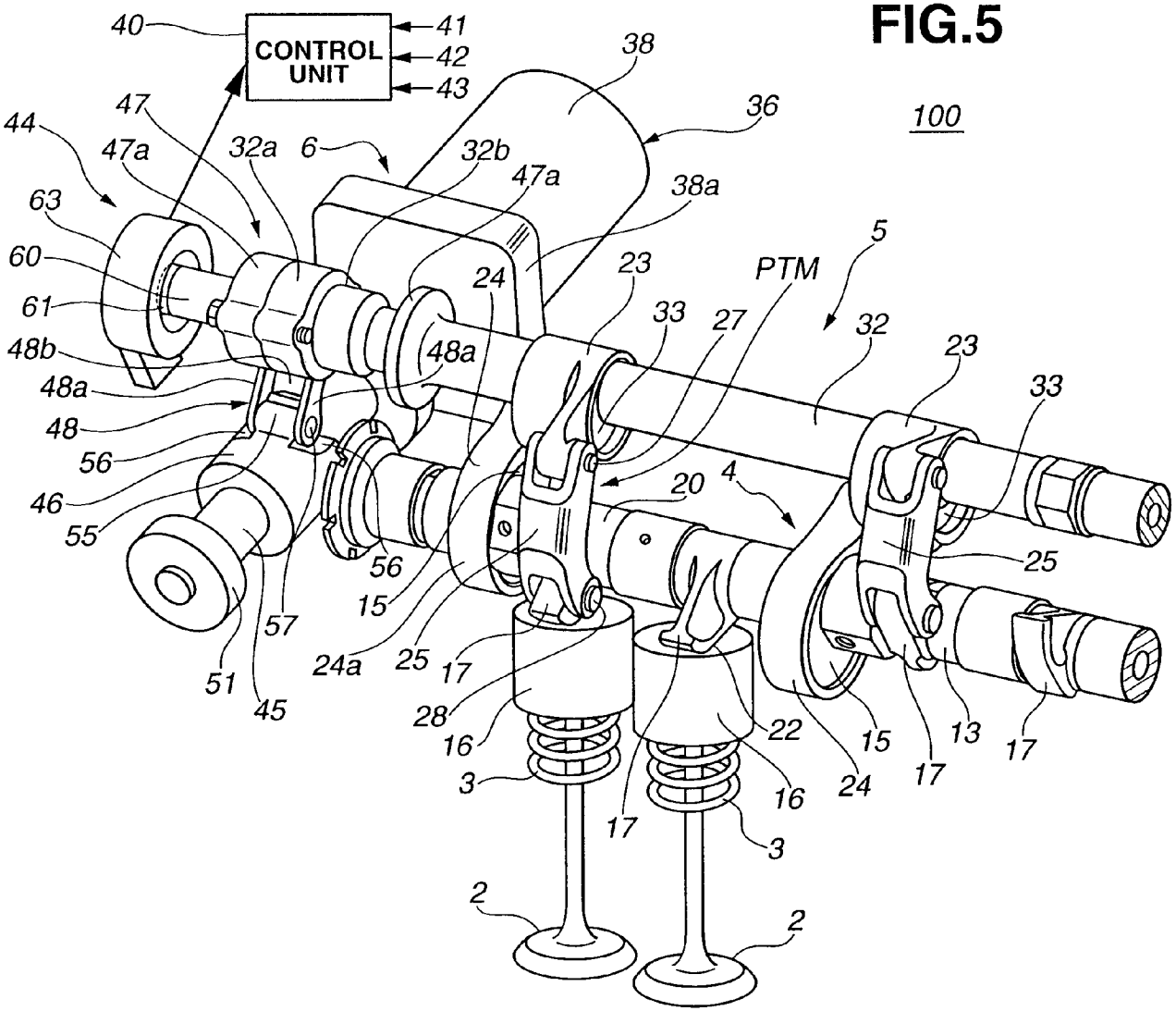
FIG. 5 is a perspective view of a variable valve system of a first embodiment of the present invention, to which the actuating mechanism is operatively applied.

As is seen from FIG. 5, the variable valve system 100 is designed to be applicable to multicylinder internal combustion engines of a type having two intake valves for each cylinder and has a function to vary a lift degree (or work angle) of the intake valves in accordance with an operation condition of the engine.

As shown in FIG. 5, the variable valve system is constructed to control operation of a pair of intake valves 2 and 2 (viz., engine valves) of the engine. Intake valves 2 and 2 are slidably guided by a cylinder head 1 (see FIG. 9A) through valve guides (not shown). Each intake valve 2 has a valve spring 3 for being biased in a closing direction, and has a valve lifter 16 mounted on a stem thereof.

As will be described in detail hereinafter, the variable valve system 100 generally comprises a valve lift mechanism 4 that induces an open/close condition of intake valves 2 and 2, a valve lift degree varying mechanism 5 that is incorporated with valve lift mechanism 4 to vary a lift degree (or work angle) of intake valves 2 and 2 and an actuating mechanism 6 that drives or actuates the valve lift degree varying mechanism 5 in accordance with an operation condition of the engine.

It is to be noted that the work angle corresponds to a time elapsed from a time when the valve 2 is just opened to a time when the valve 2 is just closed in each operation cycle of the engine.

As is seen from FIG. 5, valve lift mechanism 4 comprises a hollow drive shaft 13 that is rotatably held on an upper portion of cylinder head 1 through bearings 14 (see FIG. 9A), a drive cam 15 (see FIGS. 6 and 8) for each cylinder, that is fixed, through a press-fitting or the like, to hollow drive shaft 13 to rotate therewith, two swing cams 17 and 17 for each cylinder, that are rotatably disposed on hollow drive shaft 13 and operatively contact with valve lifters 16 and 16 of intake valves 2 and 2 to induce an open/close condition of intake valves 2 and 2 and a power transmitting mechanism "PTM" that is arranged between drive cam 15 and each of swing cams 17 and 17 to transmit a torque of drive cam 15 to swing cams 17 and 17. Actually, due to a link construction of the power transmitting mechanism, the rotary motion of drive cam 15 is converted to a swing motion of swing cams 17 and 17.

Hollow drive shaft 13 extends along an axis of the engine. Although not shown in the drawings, hollow drive shaft 13 has one end to which a torque is applied from a crankshaft of the engine through a sprocket fixed to the end of drive shaft 13 and a timing chain that is put around the sprocket and the crankshaft. That is, drive shaft 13 is driven or rotated by the crankshaft of the engine. Usually, an operation phase varying mechanism (not shown) is arranged between the crankshaft and drive shaft 13 for varying or controlling an operation phase of drive shaft 13 relative to the crankshaft.

Figure 9A:
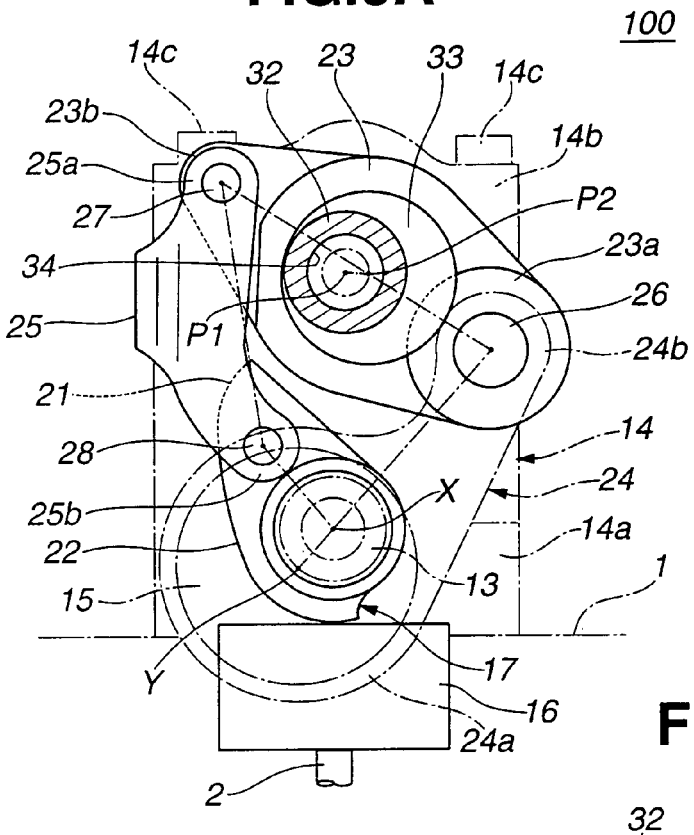

As is seen from FIG. 9A, each of bearings 14 comprises a main bracket 14*a* that is mounted on cylinder head 1 to rotatably support drive shaft 13, a sub-bracket 14*b* that is mounted on main bracket 14*a* to rotatably support an after-mentioned control shaft 32 and a pair of connecting bolts 14*c* and 14*c* that pass through sub-bracket 14*b* and main bracket 14*a* to tightly connect these brackets 14*b* and 14*a* to cylinder head 1.

Figure 8:
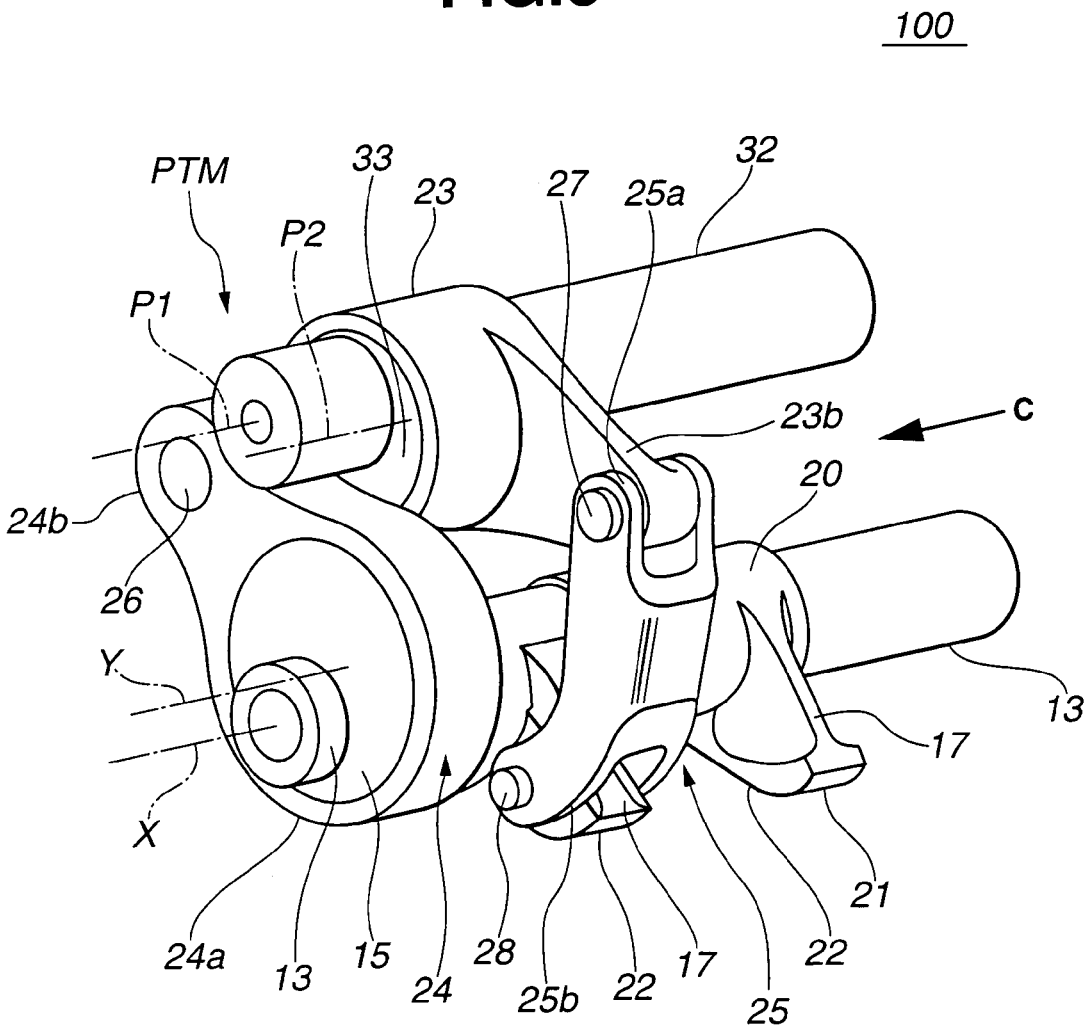
FIG. 8 is a perspective view of a part of the variable valve system of the present invention.

As is best seen from FIG. 8, drive cam 15 is a circular disc that has a center axis "Y" displaced or eccentric from a center axis "X" of drive shaft 13. More specifically, the circular disc has at an eccentric portion a circular opening through which drive shaft 13 passes. For the integral rotation between drive cam 15 and drive shaft 13, drive shaft 13 is secured to the circular opening of the drive cam 15 through press-fitting or the like. For the reason which will be described in the following, drive cam 15 has a cylindrical outer surface constituting a cam profile.

As is seen from FIG. 8, two swing cams 17 and 17 are substantially the same in construction and have a generally triangular cross section. These two swing cams 17 and 17 are integrally mounted on axially opposed end portions of a cylindrical camshaft 20 that is swingably disposed about hollow drive shaft 13, as shown. Each swing cam 17 has a cam nose portion 21 and a cam surface 22 at its lower side.

As is seen from FIG. 9A, cam surface 22 includes a base round part that extends around the cylindrical outer surface of camshaft 20, a lump part that extends from the base round part toward cam nose portion 21 and a lift part that extends from the lump part to a maximum lift point defined at the leading end of cam nose portion 21. That is, under operation, these parts of cam surface 22 slidably contact an upper surface of the corresponding valve lifter 16 in accordance with a swing movement of swing arms 17 and 17.

As is best seen from FIG. 8, power transmitting mechanism "PTM" comprises a rocker arm 23 that is positioned above drive shaft 13, a link arm 24 that pivotally connects one wing part 23*a* (see FIG. 9A) of rocker arm 23 to drive cam 15, and a link rod 25 that pivotally connects the other wing part 23*b* of rocker arm 23 to one of swing cams 17 and 17.

As is seen from FIGS. 8 and 9A, rocker arm 23 has at its middle part a cylindrical bore (no numeral) in which an after-mentioned control cam 33 is rotatably disposed. As shown in FIG. 8, wing part 23*b* of rocker arm 23 is pivotally connected to one end of link rod 25 through a pivot pin 27. As is seen from FIG. 9A and understood from FIG. 8, the other wing part 23*a* of rocker arm 23 is pivotally connected to a projected portion 24*b* of link arm 24 through a pivot pin 26.

Figure 6:
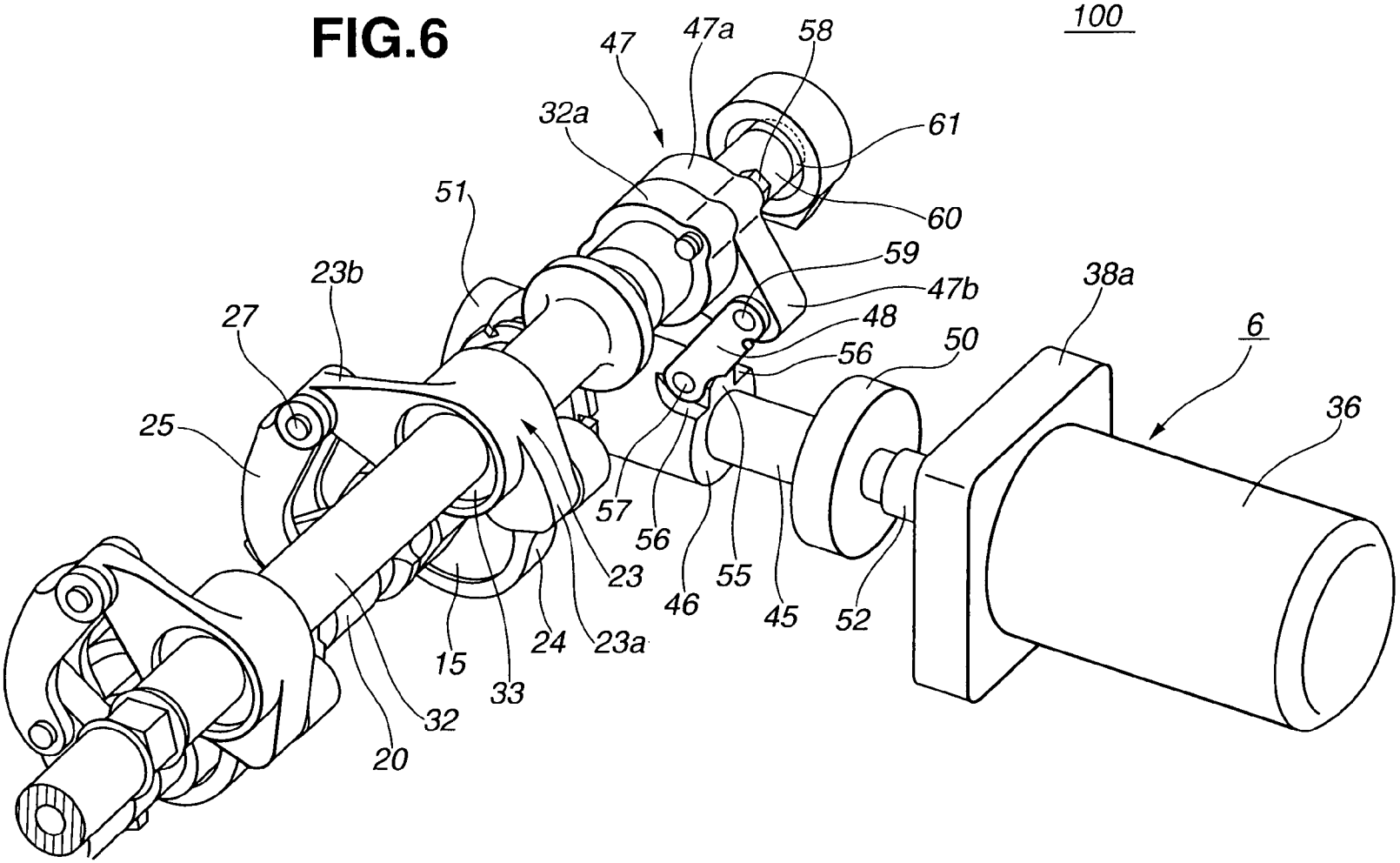
FIG. 6 is a perspective view of a part of the variable valve system of FIG. 5, that is taken from a different direction.
Figure 7:
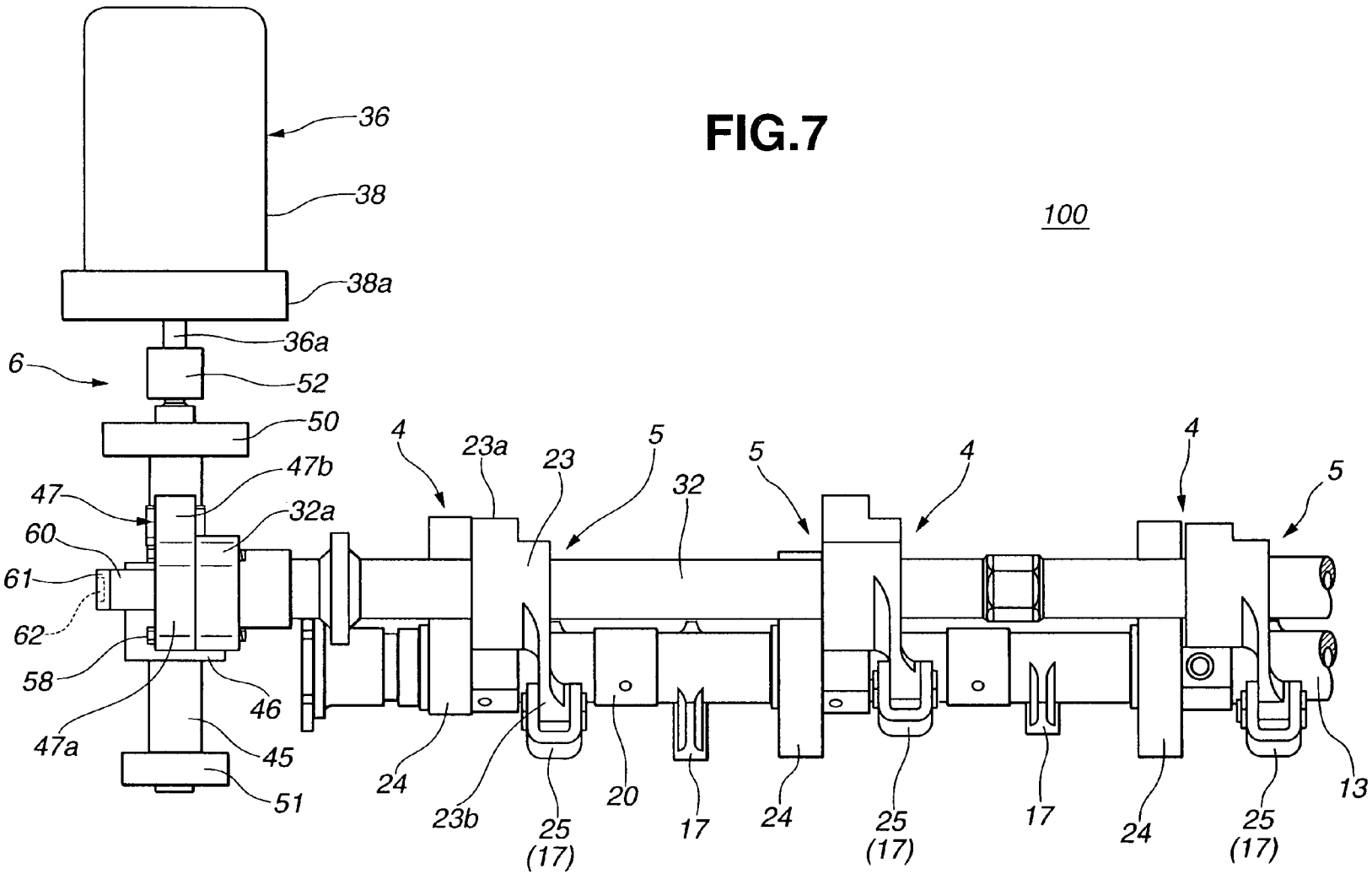
FIG. 7 is a plan view of the part of the variable valve system of FIG. 5.

As is seen from FIG. 6, the two wing parts 23*a* and 23*b* of rocker arm 23 extend radially outward from axially opposed end portions of the bored middle part of rocker arm 23.

Referring back to FIG. 8, link arm 24 comprises an annular base portion 24*a* that rotatably receives therein the above-mentioned drive cam 15 and a radially projected portion 24*b* that is pivotally connected to wing part 23*a* of rocker arm 23 through pivot pin 26.

As is best seen from FIG. 8, link rod 25 is a curved channel member that has an upper end 25*a* pivotally connected to wing part 23*b* of rocker arm 23 through pivot pin 27 and a lower end 25*b* pivotally connected to swing cam 17 through a pivot pin 28.

Although not shown in the drawings, pivot pins 26, 27 and 28 are equipped at one ends with respective snap rings for restricting axial movement of link arm 24 and link rod 25.

In the following, valve lift degree varying mechanism 5 will be described in detail with reference to the drawings.

As is seen from FIG. 5, valve lift degree varying mechanism 5 comprises a control shaft 32 that extends in parallel with the above-mentioned drive shaft 13 and is rotatably held by bearings 14 (see FIG. 9A), and a control cam 33 for each cylinder, which is secured to control shaft 32 to rotate therewith. As is mentioned hereinabove, control cam 33 is rotatably disposed in the cylindrical bore provided in the middle part of rocker arm 23. That is, control cam 33 serves as a swinging fulcrum of rocker arm 23. As is described hereinabove and seen from FIG. 9A, control shaft 32 is rotatably supported between main bracket 14*a* and sub-bracket 14*b* of each of bearings 14 that are tightly mounted on cylinder head 1.

Figure 1:
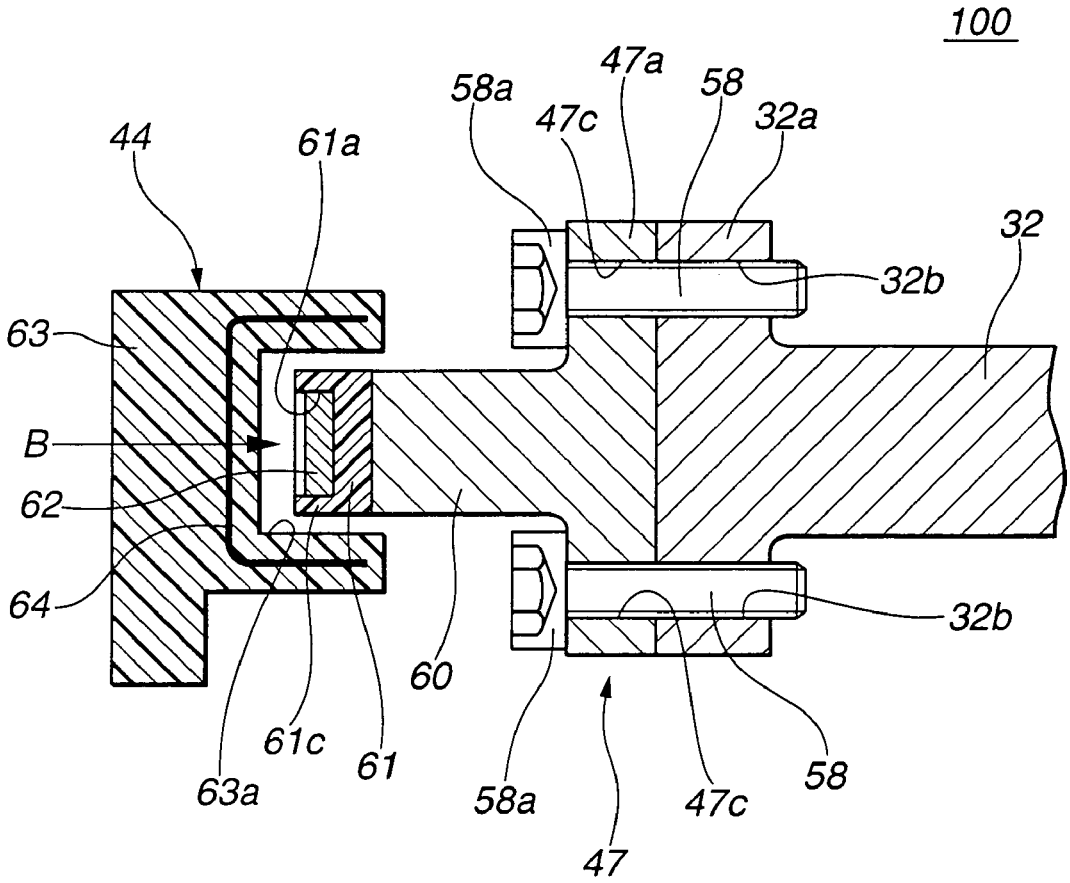
FIG. 1 is a sectional view taken along the line "A-A" of FIG. 2, showing a rotation angle sensor for sensing an angular position of a control shaft, which is employed in a first embodiment of the present invention.

As is seen from FIGS. 5 and 1, control shaft 32 is integrally formed at one end near actuating mechanism 6 with a mounting flange 32*a*. As is seen from FIG. 1, mounting flange 32*a* is formed with two threaded bolt bores 32*b* and 32*b* each extending axially. As will be understood from FIGS. 2 and 1, these threaded bolt bores 32*b* and 32*b* are not positioned at diametrically opposite positions of the flange 32*a* but positioned at asymmetrical positions with respect to the axis of control shaft 32.

As is seen from FIG. 8, control cam 33 is a circular disc that has a center axis "P2" displaced or eccentric from a center axis "P1" of control shaft 32. More specifically, the circular disc has at an eccentric portion a circular opening through which control shaft 32 passes. For the integral rotation between control cam 33 and control shaft 32, control shaft 32 is secured to the circular opening of control cam 33 through press-fitting or the like.

In the following, actuating mechanism 6 will be described with reference to the drawings, particularly FIGS. 3, 5, 6 and 7.

Figure 3:
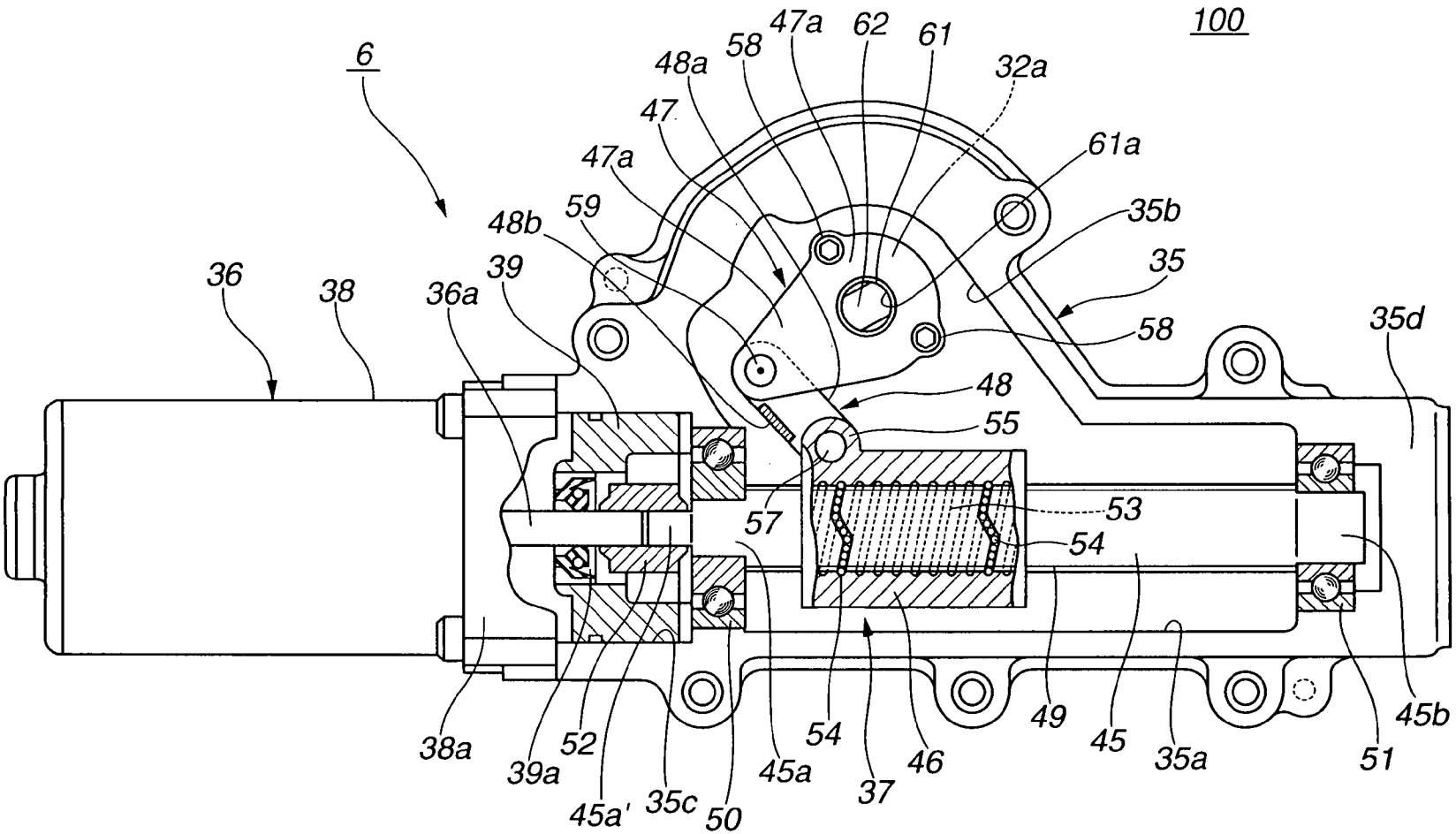
FIG. 3 is a partially cut plan view of an actuating mechanism for the control shaft, which is employed in the first embodiment, showing a condition to induce a lowest lift of intake valves.

As is understood from FIGS. 3 and 5, actuating mechanism 6 comprises a cylindrical housing 35 that is mounted on cylinder head 1 and extends perpendicular to drive shaft 13, and thus, to control shaft 32, an electric motor 36 that is coaxially connected to one end of cylindrical housing 35, and a ball-screw type transmission mechanism 37 (see FIG. 3) that is installed in cylindrical housing 35. It is to be noted that cylindrical housing 35 is not shown in FIG. 5 for clarification of the parts installed in the housing 35. As will become apparent hereinafter, ball-screw type transmission mechanism 37 functions to transmit a torque of electric motor 36 to the above-mentioned control shaft 32.

As is seen from FIG. 3, cylindrical housing 35 is constructed of an aluminum alloy or the like and includes generally an elongate lower bore 35*a* that extends axially along the housing 35 and an upper bore 35*b* that projects upward from a middle portion of elongate lower bore 35*a*. That is, these two bores 35*a* and 35*b* are merged to constitute a so-called part receiving room. As shown, in elongate lower bore 35*a*, there is arranged the above-mentioned ball-screw type transmission mechanism 37, and into upper bore 35*b*, there is exposed the above-mentioned mounting flange 32*a* of control shaft 32.

Although not shown in FIG. 3, the part receiving room including the two bores 35*a* and 35*b* is covered by a cover member. As shown in this drawing, elongate lower bore 35*a* has a left end 35*c* opened and a right end closed by a wall 35*d*.

Electric motor 36 is of DC type which comprises a cylindrical casing 38 that has an opened base end 38*a* tightly connected to the opened left end 35*c* of elongate lower bore 35*a*. Electric motor 36 has an output shaft 36*a* rotatably held by a retainer 39 tightly received in the opened left end 35*c*. For sealing output shaft 36*a*, there is used a mechanical seal 39*a* between retainer 39 and output shaft 36*a*.

As is seen from FIG. 5, electric motor 36 is controlled by a control unit 40. That is, control unit 40 issues an instruction signal to electric motor 36 by processing various information signals fed thereto. These information signals are for example the signals from a crank angle sensor 41, an air flow meter 42, an engine cooling water temperature sensor 43 and an after-mentioned rotation angle sensor 44 for control shaft 32. By processing these information signals, control unit 40 derives the current operation condition of the engine and issues a suitable instruction signal to electric motor 36 in accordance with the derived operation condition of the engine.

Referring back to FIG. 3, ball-screw type transmission mechanism 37 generally comprises a ball-screw shaft 45 that extends axially in elongate lower bore 35*a* and is coaxial with output shaft 36*a* of electric motor 36, a ball-nut 46 that is operatively engaged with ball-screw shaft 45, a connecting arm (or mounting member) 47 that is tightly put on mounting flange 32*a* of control shaft 32 (see FIG. 1), and a link member 48 that pivotally connects connecting arm 47 and ball-nut 46. Connecting arm 47 and link member 48 thus constitute a transmission mechanism.

Ball-screw shaft 45 is formed with a threaded outer surface 49 except axially opposite end portions 45*a* and 45*b* thereof. As shown, opposite end portions 45*a* and 45*b* of ball-screw shaft 45 are rotatably held by left and right ball bearings 50 and 51 which are tightly held in elongate lower bore 35*a*. As shown, left ball bearing 50 is press-fitted in the bore 35*a* near the opened left end 35*c*, and right ball bearing 51 is press-fitted in a diametrically reduced right end of the bore 35*a*.

Left end portion 45*a* of ball-screw shaft 45 has a hexagon head 45*a*' that is axially movably received in a hexagon socket 52 that is fixed to a leading end of output shaft 36*a* of electric motor 36. Thus, output shaft 36*a* and ball-screw shaft 45 can rotate together like a unit while having an axial relative movement therebetween permitted.

Ball-nut 46 is engaged or meshed with ball-screw shaft 45 so that rotation of ball-screw shaft 45 about its axis induces a forward or rearward movement of ball-nut 46 along ball-screw shaft 45. That is, ball-nut 46 is a cylindrical member that has a bore whose inner surface is formed with a spiral thread 53 that is meshed with a spiral thread 49 formed on the outer surface of ball-screw shaft 45. A plurality of fine balls 54 are operatively received in spiral thread 53 of ball-nut 46 for achieving a smoothed movement of ball-nut 46 along ball-screw shaft 45. Two deflectors (no numerals) are provided by spiral thread 53 of ball-nut 46 to produce an endless screw passage of the threads in and along which fine balls 54 run endlessly under movement of ball-nut 46 along ball-screw shaft 45.

Thus, in operation, rotation of ball-screw shaft 45 about its axis is converted to axial movement of ball-nut 46 through fine balls 54.

Figure 2:
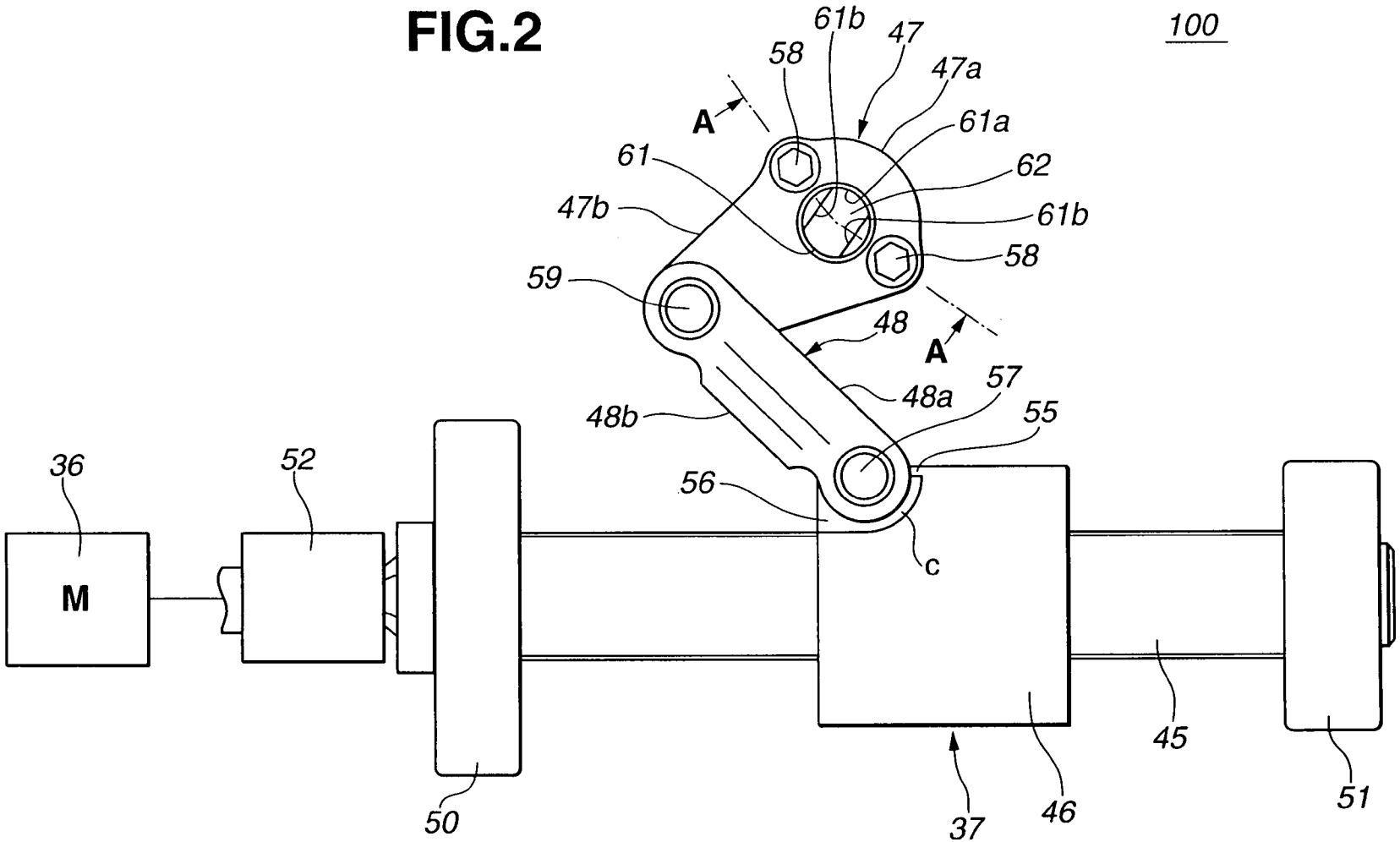
FIG. 2 is a side view taken from the direction of the arrow "B" of FIG. 1, showing a unit including a ball-screw shaft and a ball-nut, which is employed in the first embodiment of the present invention.

As is seen from FIGS. 2, 3 and 6, ball-nut 46 is formed with a round projection 55 to which a lower end of the above-mentioned link member 48 is pivotally connected through a pivot pin 57. As shown in FIG. 6, at axially opposite sides of round projection 55, ball-nut 46 is formed with curved cuts 56 which permit a swing movement of round lower ends of link member 48. That is, as is seen from FIG. 2, due to provision of the curved cuts 56 on ball-nut 46, there is defined a round clearance "c" between the bottom of each curved cut 56 and the corresponding round lower end of link member 48.

As is seen from FIGS. 2 and 3, connecting arm 47 is generally triangular in shape and comprises a larger base portion 47*a* that is secured to mounting flange 32*a* of control shaft 32 through two bolts 58 and 58, and an arm portion 47*b* that extends radially outward from larger base portion 47*a*.

As is seen from FIG. 1, larger base portion 47*a* of connecting arm 47 is formed with two bolt bores 47*c* and 47*c* which are mated with the above-mentioned threaded bores 32*b* and 32*b* of mounting flange 32*a* of control shaft 32 respectively. Thus, when two bolts 58 and 58 passing through bolt bores 47*c* and 47*c* are screwed sufficiently in respective threaded bores 32*b* and 32*b* in a fastening direction, connecting arm 47 is tightly secured to mounting flange 32*a* of control shaft 32. As has been mentioned hereinabove and as is seen from FIG. 2, the two bolts 58 and 58 are positioned at asymmetrical positions with respect to the axis of control shaft 32.

As is seen from FIGS. 2 and 3, arm portion 47*b* of connecting arm 47 is pivotally connected to an upper end of link member 48 through a pivot pin 59.

As is seen from FIGS. 2 and 5, link member 48 has a generally U-shaped cross section and is produced by pressing a flat metal plate. That is, link member 48 comprises two parallel wall portions 48*a* and 48*a* and a bridge portion 48*b* that extends between the two parallel wall portions 48*a* and 48*a*.

As is seen from FIG. 2, for the pivotal connection between the upper end of link member 48 and arm portion 47*b* of connecting arm 47 by means of pivot pin 59, the arm portion 47*b* is sandwiched between upper sections of the two parallel wall portions 48*a* and 48*a*, and as is seen from FIG. 5, for the pivotal connection between the lower end of the link member 48 and round projection 55 of ball-nut 46 by means of pivot pin 57, the round projection 55 is sandwiched between lower sections of the two parallel wall portions 48*a* and 48*a*.

Figure 4:
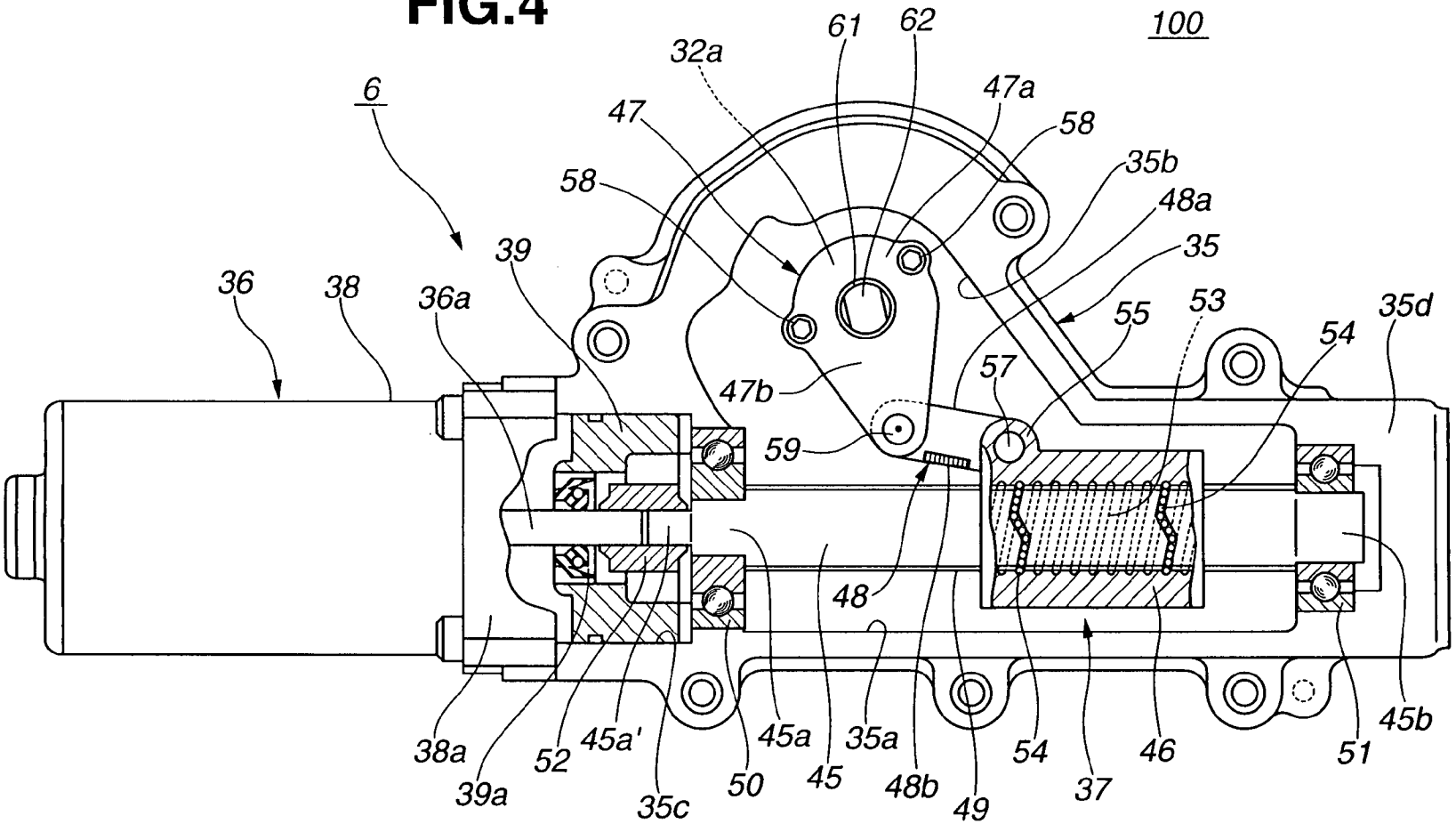
FIG. 4 is a view similar to FIG. 3, but showing a condition to induce a highest lift of the intake valves.

Thus, as is understood from FIGS. 3 and 4, under movement of ball-nut 46 along ball-screw shaft 45, link member 48 is forced to pivot about round projection 55 pulling or pushing connecting arm 47.

As is seen from FIGS. 3, 1 and 5, larger base portion 47*a* of connecting arm 47 is formed at its center area with a cylindrical projection 60 which is coaxial with control shaft 32. As is seen from FIGS. 1 and 5, the diameter of cylindrical projection 60 is somewhat smaller than that of control shaft 32.

As is seen from FIG. 1, to a leading end of cylindrical projection 60, there is fixed a cylindrical plastic holder 61 through an injection molding.

As is seen from FIGS. 1 and 2, plastic holder 61 is formed at its exposed front side with a diametrically extending broad groove 61*a* that comprises mutually facing two walls 61*b* and 61*b*.

As is seen from FIG. 1, within broad groove 61*a* of holder 61, there is tightly set a disc 62 of a permanent magnet, which constitutes part of the above-mentioned rotation angle sensor 44. As shown, the thickness of magnet disc 62 is smaller than the depth of the groove 61*a*. For the tight setting of magnet disc 62 in the groove 61*a*, diametrically opposed portions of magnet disc 62 are formed flat and intimately pressed against the mutually facing walls 61*b* and 61*b*. Because magnet disc 62 is deeply received in the groove 61*a*, and thus due to provision of a surrounding wall 61*c* thus produced around the groove 61*a*, the magnetic force from magnet disc 62 is suppressed from a radial leakage. It is to be noted that magnet disc 62 is positioned away from heads 58*a* and 58*a* of the bolts 58 and 58 for avoiding or at least minimizing influence of the heads 58*a* and 58*a* applied to rotation angle sensor 44.

Rotation angle sensor 44 comprises the above-mentioned magnet disc 62, a plastic sensor casing 63 that is installed in the above-mentioned cylindrical housing 35 in front of magnet disc 62, and a Hall element 64 that is embedded in sensor casing 63.

As shown, plastic sensor casing 63 is formed with a cylindrical recess 63*a* in which cylindrical plastic holder 61 of cylindrical projection 60 is coaxially received with a certain annular clearance defined therebetween. Hall element 64 has a generally U-shaped cross section and is arranged to cover cylindrical recess 63*a*, as shown. Under rotation of magnet disc 62, magnetic forces from N and S poles of magnet disc 62 are sensed by Hall element 64 and issues corresponding information signal to control unit 40.

In the following, operation of variable valve system 100 of the first embodiment will be described with reference to the drawings, particularly FIGS. 1, 3, 4, 5 and 6.

For ease of understanding, the description on the operation will be commenced with respect to a condition wherein the engine runs at a lower speed, such as a speed in case of idling.

In such case, as is seen from FIG. 5, electric motor 36 is operated in accordance with an instruction signal outputted from control unit 40. As is seen from FIG. 6, upon this, a torque produced by electric motor 36 is transmitted to ball-screw shaft 45 to rotate the same. With this, as is seen from FIGS. 3 and 2, ball-nut 46 is moved axially along ball-screw shaft 45 in a left direction allowing fine balls 54 to run in and along a passage that is defined by and between spiral thread 53 of ball-nut 46 and spiral thread 49 of ball-screw shaft 45. That is, ball-nut 46 is moved toward electric motor 36 in FIG. 5.

Accordingly, as is seen from FIG. 2, connecting arm 47 and thus control shaft 32 are turned clockwise in the drawing. That is, control shaft 32 is rotated counterclockwise in FIGS. 9A and 5.

Figure 9B:
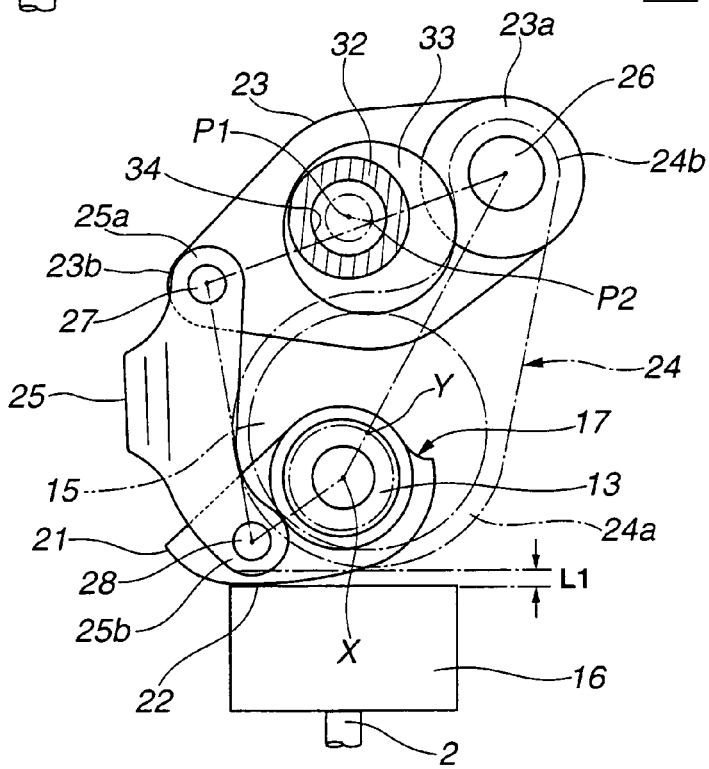

Upon this, as is seen from FIGS. 9A and 9B, control cam 33 is turned counterclockwise about the axis "P1" of control shaft 32 moving the thickest cam part thereof upward away from drive shaft 13, and control cam 33 takes the angular position as shown in these drawings. In other words, in this case, the entire construction of rocker arm 23 takes a relatively high position. Thus, under this condition, as is seen from FIG. 9A, the uppermost position that can be taken by pivot pin 27 provided between the left wing part 23*b* of rocker arm 23 and upper end 25*a* of link rod 25 is a first position that is remote from drive shaft 13. This means that as is seen from FIGS. 9A and 9B, under operation of the variable valve system, link rod 25 and thus swing cam 17 are forced to operate at a position remote from valve lifter 16.

Figure 11:
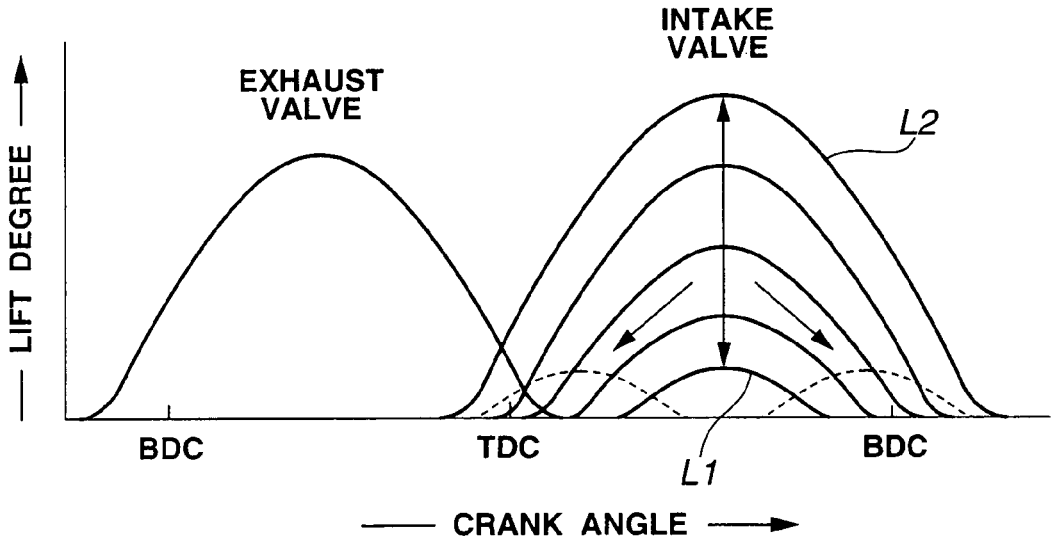
FIG. 11 is a graph showing a valve lift characteristic of each intake valve, which is induced by the variable valve system of the present invention.

Accordingly, when, due to rotation of drive shaft 13, drive cam 15 is rotated in annular base portion 24*a* of link arm 24, rocker arm 23 is forced to swing reciprocating link rod 25 and swing cam 17 at such a position remote from valve lifter 16. That is, as is seen from FIG. 9B, under this condition, the valve lift shows the smallest degree "L1" as is seen from the graph of FIG. 11. That is, improved fuel consumption and stable running of the engine are achieved in such lower speed condition. In FIG. 11, reference "BDC" indicates a bottom dead center and reference "TDC" indicates a top dead center.

In such low speed operation of the engine, alternating torque applied to control shaft 32 is sufficiently small, and thus, a load transmitted to ball-nut 46 through connecting arm 47 and link member 48 is sufficiently small. Thus, a stress applied to both spiral thread 53 of ball-nut 46 and spiral thread 49 of ball-screw shaft 45 is very small, which prevents undesired frictional wear of fine balls 54 and spiral threads 53 and 49.

When the engine is subjected to a high speed operation, control unit 40 (see FIG. 5) controls electric motor 36 to run in a reversed direction. As is seen from FIG. 4, upon this, ball-nut 46 is moved rightward. That is, ball-nut 46 is moved away from electric motor 36 in FIG. 5.

Accordingly, as is seen from FIG. 4, connecting arm 47 and thus control shaft 32 are turned counterclockwise in the drawing. That is, control shaft 32 is rotated clockwise in FIGS. 9A and 5.

Figure 10A:
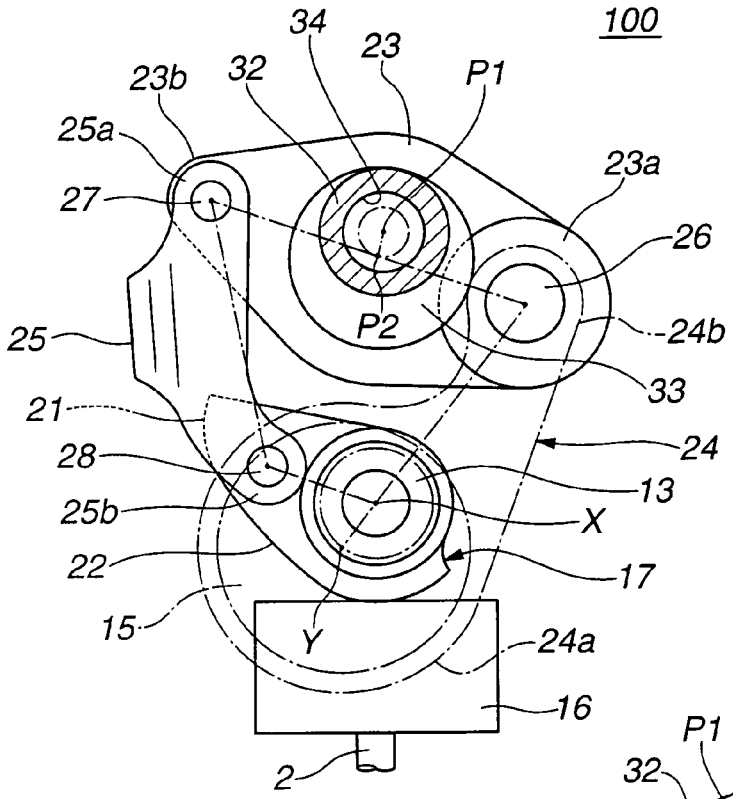
Figure 10B:
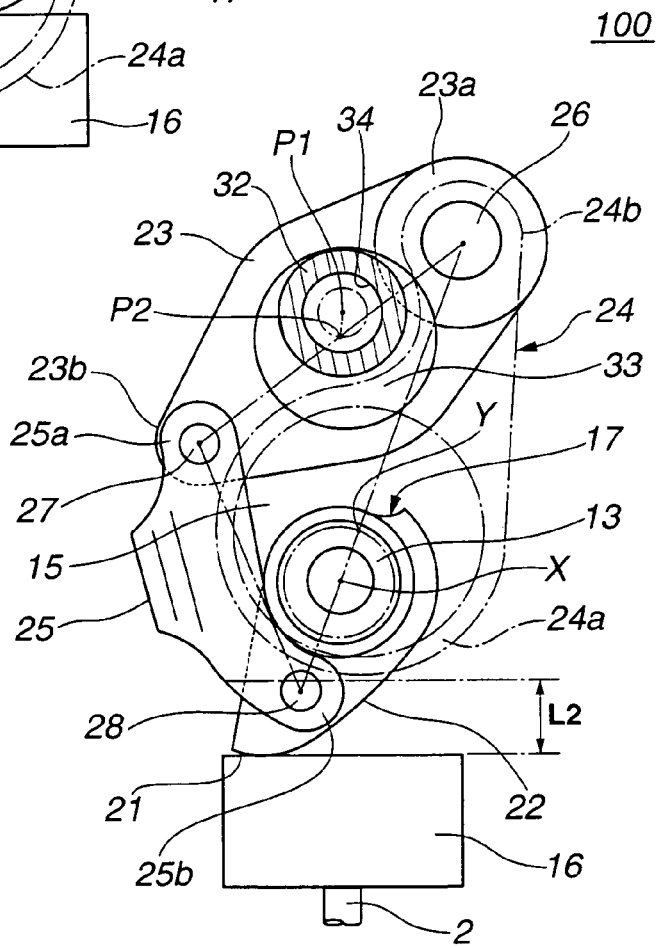

Upon this, as is seen from FIGS. 9A, 10A and 10B, control cam 33 is turned clockwise about the axis "P1" of control shaft 32 moving the thickest cam part thereof downward toward drive shaft 13, and control cam 33 takes the angular position as shown in FIGS. 10A and 10B. In other words, in this case, the entire construction of rocker arm 23 takes a relatively low position. Thus, under this condition, as is seen from FIG. 10A, the uppermost position that can be taken by pivot pin 27 is a second position that is near drive shaft 13 as compared with the above-mentioned first position. This means that as is seen from FIGS. 10A and 10B, under operation of variable valve system, link rod 25 and thus swing cam 17 are forced to operate at a position near valve lifter 16.

Accordingly, when, due to rotation of drive shaft 13, drive cam 15 is rotated in annular base portion 24*a* of link arm 24, rocker arm 23 is forced to swing reciprocating link rod 25 and swing cam 17 at such a position near valve lifter 16. That is, as is seen from FIG. 10B, under this condition, the valve lift shows the largest degree "L2" as is seen from the graph of FIG. 11. As is seen from this graph, the close timing of each intake valve 2 is retarded in accordance with an advancement of the open timing. That is, the work angle is increased. Thus, intake air charging efficiency is increased and thus sufficient engine power is achieved in such high speed condition.

In such high speed operation of the engine, alternating torque applied to control shaft 32 is high as compared with the case of the above-mentioned low speed operation. However, since, as is seen from FIG. 4, the angle defined between ball-screw shaft 45 and link member 48 shows a degree sufficiently smaller than that provided in the above-mentioned low speed operation, viz., in case of the smallest lift degree, a radial load is sufficiently depressed, and thus, the larger alternating torque transmitted to ball-nut 46 through connecting arm 47 and link member 48 is entirely received through fine balls 54 by both spiral thread 53 of ball-nut 46 and spiral thread 49 of ball-screw shaft 45. That is, the input load to ball-nut 46 is entirely dispersed in a circumferential direction, and thus undesired concentration of the load can be avoided.

Accordingly, undesired frictional wear of fine balls 54 and spiral threads 53 and 49 is effectively prevented, which improves the durability of such torque transmission device.

As is described hereinabove, the torque of ball-screw shaft 45 is transmitted to ball-nut 46 with the aid of fine balls 54 that roll in the spiral passage defined by spiral thread 53 of ball-nut 46 and spiral thread of ball-screw shaft 45, and thus, the frictional resistance between adjacent parts is reduced, so that the axial movement of ball-nut 46 along ball-screw shaft 45 is smoothed and thus the response of the movement of ball-nut 46 to the instruction signal from control unit 40 is improved. That is, the response of operation of intake valves 2 and 2 is improved.

As is described hereinabove and shown in FIGS. 1 and 2, larger base portion 47*a* of connecting arm 47 is connected to control shaft 32 by means of two connecting bolts 58 and 58 which are arranged at asymmetrical positions with respect to the axis of control shaft 32. Thus, undesired looseness of these bolts 58 and 58, which would be caused by the alternating torque applied to control shaft 32, is assuredly suppressed. Accordingly, as is seen from FIG. 1, the permanent magnet disc 62 held on the leading end of connecting arm 47 can provide Hall element 64 with a reliable information on an angular position of control shaft 32. That is, rotation angle sensor 44 can output a precise information signal on the angular position of control shaft 32 to control unit 40.

Because of usage of two connecting bolts 58 and 58, the torque transmitted to connecting arm 47 from ball-nut 46 through link member 48 is assuredly transmitted to control shaft 32 to rotate the same.

As is seen from FIG. 1, magnet disc 62 is positioned sufficiently away from heads 58*a* and 58*a* of connecting rods 58 and 58 and magnet disc 62 is deeply received in the groove 61*a* of plastic holder 61, influence of heads 58*a* and 58*a* to the disc 62 is suppressed or at least minimized, which improves the performance of rotation angle sensor 44.

Cylindrical projection 60 is integrally formed on larger base portion 47*a* of connecting arm 47, which assures the positioning of magnet disc 62 relative to the Hall element 64 and thus improve the performance of rotation angle sensor 44.

As is seen from FIG. 2, two connecting bolts 58 and 58 are arranged at asymmetrical positions with respect to the axis of control shaft 32. This arrangement is quite advantageous in avoiding misconnection of connecting arm 47 to control shaft 32.

Since link member 48 is produced by pressing a flat metal plate, the link member 48 can have a very light weight, which minimizes an energy loss that would be inevitably produced when a torque transmission is effected from ball-nut 46 to connecting arm 47. That is, moving load of ball-nut 46 can be lowered.

Ball-nut 46 is formed at axially opposite sides of round projection 55 with respective curved cuts 56 for permitting the swing movement of rounded lower ends of link member 48. Thus, round projection 55 (see FIG. 5) can be positioned sufficiently close to ball-screw shaft 45, and thus, a unit including ball-nut 46 and link member 48 can have a compact construction. Furthermore, due to integral provision of round projection 55 on ball-nut 46, the mechanical strength of ball-nut 46 is increased.

Figure 12:
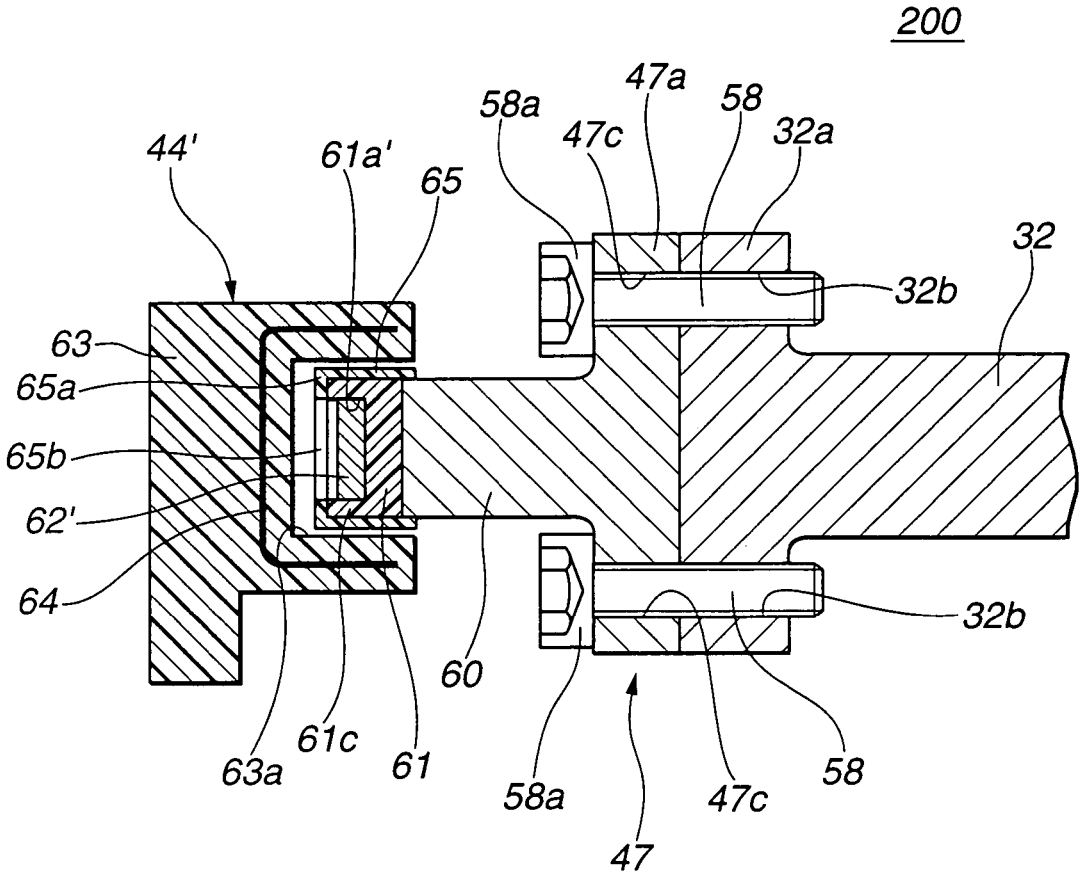
FIG. 12 is a view similar to FIG. 1, but showing a rotation angle sensor which is incorporated with an actuating mechanism employed in a second embodiment of the present invention.
Figure 13:
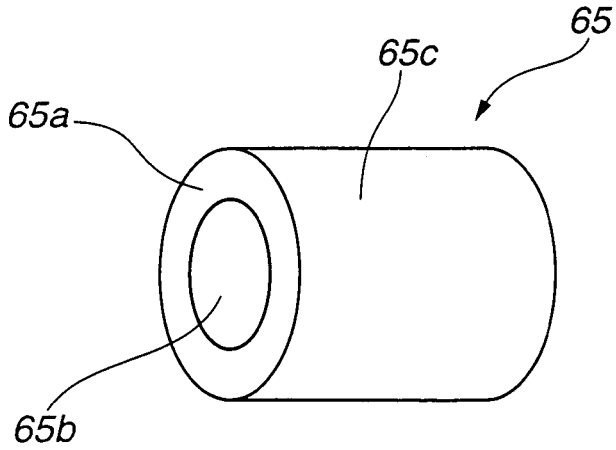
FIG. 13 is a perspective view of a guard cap applied to the rotation angle sensor of FIG. 12.

Referring to FIGS. 12 and 13, particularly FIG. 12, there is shown a rotation angle sensor 44' for sensing an angular position of control shaft 32, which is used in an actuating mechanism employed in the second embodiment 200 of the present invention.

In this second embodiment, as is seen from FIG. 12, a cylindrical recess 61*a*' is provided in the front side of plastic holder 61 and a circular magnet disc 62' is deeply received in cylindrical recess 61*a*'. Furthermore, an apertured plastic guard cap 65 is put on plastic holder 61 in such a manner that a circular opening 65*b* thereof is merged with cylindrical recess 61*a*' of plastic holder 61.

The detail of guard cap 65 is shown in FIG. 13. Guard cap 65 comprises a cylindrical wall 65*c* that has a size to sufficiently cover the cylindrical wall of plastic holder 61, an annular ridge 65*a* that projects radially inward from the leading end of cylindrical wall 65*c* and the circular opening 65*b* that is defined by annular ridge 65*a*, as shown.

With provision of guard cap 65, circular magnet disc 62' and plastic holder 61 are safely protected from other parts during assembling step of the actuating mechanism 6. Furthermore, due to provision of such guard cap 65, the radial leakage of the magnetic force from magnet disc 62' is much effectively suppressed or at least minimized.

In the following, various modifications of the present invention will be described.

In the foregoing description, electric motor 36 is described to be arranged at the left side in FIGS. 3 and 4. However, if desired, such electric motor 36 may be arranged at a right side of the drawings. Of course, in this case, turning of ball-screw shaft 45 by the electric motor should be made same as that as mentioned hereinabove. Furthermore, in place of electric motor 36, a hydraulic motor may be used. Furthermore, fixing of magnet disc 62 or 62' to plastic holder 61 may be made by using a male-female threading connection. Furthermore, as a material of holder 61, hard rubber, aluminum and the like may be used. Furthermore, in place of the deflectors that produce an endless screw passage in and along which fine balls 54 run endlessly, tubes may be used. Furthermore, ball-nut 46 may be engaged with ball-screw shaft 45 without usage of fine balls 54.

The foregoing description is directed to the variable valve system 100 or 200 of the present invention that is designed to control intake valves 2 and 2 of the internal combustion engine. However, of course, the variable valve system of the present invention can be used for controlling exhaust valves of the engine.

The entire contents of Japanese Patent Application 2004-85904 filed Mar. 24, 2004 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A variable valve system for varying an operation condition of an engine valve that is biased in a valve closing direction by a valve spring, comprising:

a valve lift degree varying mechanism that varies the operation condition of the engine valve in accordance with an angular position assumed by a control shaft;

an actuating mechanism that controls the angular position of the control shaft in accordance with an operation condition of the engine, wherein a mounting member is constructed to constitute part of the actuating mechanism, wherein the mounting member is connected to one end of the control shaft to rotate therewith, and wherein the mounting member is fixed to the one end of the control shaft by a plurality of bolts;

a non-magnetic member connected to an axial end of the mounting member that faces away from the control shaft;

a permanent magnet piece fixed within the non-magnetic member; and a sensing device that senses a rotation condition of the permanent magnet piece;

2. A variable valve system as claimed in claim 1, in which the non-magnetic member is a plastic member that is molded to the mounting member through an injection molding.

3. A variable valve system as claimed in claim 1, in which the sensing device is a Hall element.

4. A variable valve system as claimed in claim 1, in which the actuating mechanism further comprises:

an arm portion integral with and extending radially outward from the mounting member;

a threaded shaft rotatable about its axis;

a drive mechanism that rotates the threaded shaft in accordance with the operation condition of the engine;

a nut member operatively engaged with the threaded shaft, so that upon rotation of the threaded shaft, the nut member runs axially along the threaded shaft; and a link member that is pivotally connected to both the arm portion and the nut member, so that the axial movement of the nut member along the threaded shaft induces the rotation of the control shaft about the control shaft axis.

5. A variable valve system as claimed in claim 1, further comprising a guard cap that covers the permanent magnet piece except a portion that faces the sensing device, the guard cap being constructed of a non-magnetic material.

6. A variable valve system as claimed in claim 1, in which the guide cap is constructed of a plastic.

7. A variable valve system as claimed in claim 1, wherein the mounting member comprises a larger base portion that is secured to a mounting flange of the control shaft by the plurality of bolts, and an arm portion that extends outward from the larger base portion.

8. A variable valve system as claimed in claim 7, wherein the larger base portion of the mounting member is formed with bolt bores which correspond to threaded bores formed on the mounting flange of the control shaft.

9. A variable valve system as claimed in claim 1, wherein the plurality of bolts are positioned at asymmetrical positions with respect to the axis of control shaft.

* * * * *